United States Patent [19]

Mentzer

[11] Patent Number: 4,484,686

[45] Date of Patent: Nov. 27, 1984

[54] MULTIPLE OFFSET BOOM EXTENSION

[75] Inventor: William R. Mentzer, Shady Grove, Pa.

[73] Assignee: Kidde, Inc., Saddle Brook, N.J.

[21] Appl. No.: 371,133

[22] Filed: Apr. 23, 1982

[51] Int. Cl.[3] ..... B66C 23/66

[52] U.S. Cl. ..... 212/188; 212/266; 212/177; 403/85; 248/291

[58] Field of Search ..... 212/168, 177, 187, 188, 212/202, 204, 264, 182, 267; 248/558, 291, 292.1, 647; 52/116, 117; 403/85, 116, 113, 91

[56] References Cited

U.S. PATENT DOCUMENTS

| | | | |
|---|---|---|---|
| 2,091,806 | 8/1937 | Clements | 403/85 |
| 2,239,297 | 4/1941 | Allen et al. | 403/85 |
| 3,085,695 | 4/1963 | Miller | 212/182 |
| 3,370,717 | 2/1968 | Reapsummer | 212/189 |
| 3,691,866 | 9/1972 | Berkes | 403/85 |
| 3,698,569 | 10/1972 | Lamer et al. | 212/177 |
| 3,785,505 | 1/1974 | Keller | 212/177 |
| 3,977,148 | 8/1976 | Ranini | 212/177 |
| 4,106,631 | 8/1978 | Landy | 212/177 |

FOREIGN PATENT DOCUMENTS

| | | | |
|---|---|---|---|
| 73455 | 6/1977 | Japan | 212/188 |

*Primary Examiner*—Trygve M. Blix
*Assistant Examiner*—Thomas J. Brahan
*Attorney, Agent, or Firm*—Brady, O'Boyle & Gates

[57] ABSTRACT

A side stowable swing-around boom extension is pinned on the nose of a telescoping crane boom in a first use position nearly coaxial with the center line of the boom but tilted or offset therefrom at a small angle. Two larger angularly offset use positions of the boom extension are obtained with convenience and with complete safety while the crane boom and boom extension are at a near ground level position. Two slotted tension links are connected between the upper side of the boom extension and the boom nose and are allowed to support the boom extension in either of two major offset use positions automatically as the crane boom is elevated from the near ground level position. In such operation, the boom extension is allowed to rotate around the axis of its lower side pivotal connection with the boom nose while its upper side connection with the nose is released. The lower side connection is biased toward a position corresponding to the nearly coaxial use position of the boom extension.

12 Claims, 6 Drawing Figures

MULTIPLE OFFSET BOOM EXTENSION

BACKGROUND OF THE INVENTION

This invention has for its principal object the provision of a simplified, convenient and safe means to positively position a crane boom extension precisely at several different angularly offset use positions relative to the center line of the telescopic crane boom.

Another objective is to be able to accomplish the above offsetting adjustments of the boom extension at ground level in a semi-automatic mode by use of a very simple mechanism which can remain permanently attached to the boom extension.

Prior U.S. Pat. Nos. 3,831,771 and 3,968,884 show arrangements which permit the angular offsetting of boom extensions or jibs relative to the center line of a crane boom. In the former patent, the offsetting adjustments are achieved through the use of interchangeable variable length connecting links between the base of the boom extension and the boom nose on opposite sides of the pivot for the boom extension. In the latter patent, the offsetting adjustments of the boom extension are obtained by the use of guy lines and coacting struts which limit the extent to which the boom extension can be offset or tilted. It is necessary to connect the guy lines at different positions on the boom and boom extension to achieve the desired angular offsetting.

Both of these prior art arrangements tend to be awkward or inconvenient and neither possess the simplicity of construction and the semi-automatic mode of operation of the present invention at a near ground level position of the boom.

The above and other advantages of the invention over the prior art will become apparent during the course of the following description.

DETAILED DESCRIPTION

Figures 1, 6:
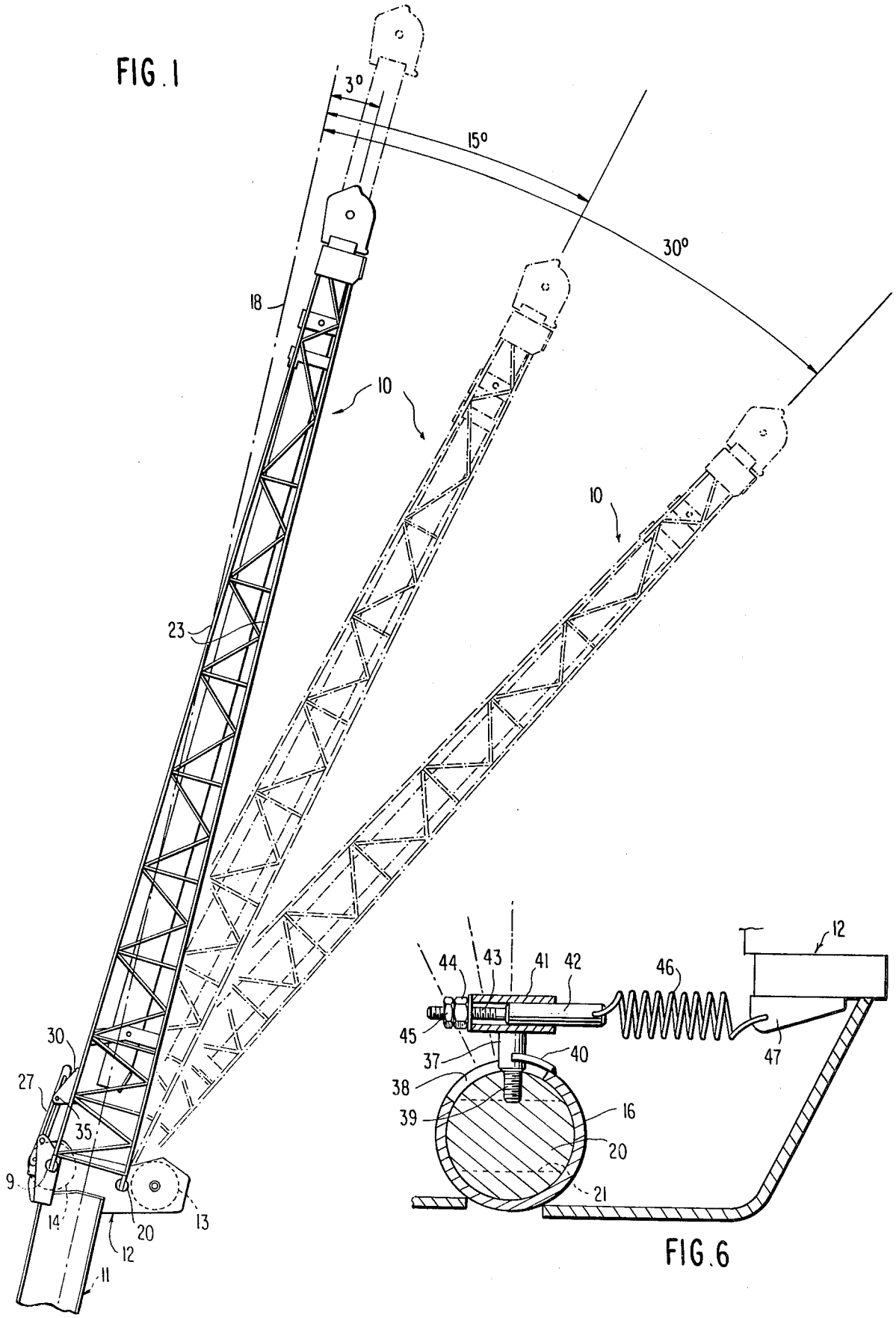
FIG. 1 is a side elevation of a multiple offset boom extension according to the invention.
FIG. 6 is an enlarged fragmentary vertical section taken on line 6—6 of FIG. 3 showing biasing means for the lower side pivotal connection of the boom extension with the crane boom nose.

Referring to the drawings in detail wherein like numerals designate like parts, a boom extension 10 of the side stowable swing-around type is illustrated in the drawings in its several use positions on a conventional telescoping crane boom 11 whose fly section is equipped with the customary nose assembly 12 including sheaves 13 and 14. The nose assembly 12 on its upper side includes a pair of fixed coaxial sleeves 15 and on its lower side a single continuous sleeve 16, all securely welded to the nose assembly. The axes of sleeves 15 and 16 are parallel. As best shown in FIG. 2, the axes of sleeves 15 and 16 are offset by approximately 3° or a similar small angle with respect to a true vertical plane 17 through the center of upper sleeves 15. As will become more apparent, this particular geometry establishes the first use position of the boom extension 10 shown in full lines in FIG. 1 wherein the boom extension is nearly coaxial with the boom 11 but actually offset by 3° to the boom center line 18.

In this first use position of the boom extension 10 as shown in FIGS. 1 through 4 of the drawings, the boom extension is rigidly connected to the nose assembly 12 through upper and lower shafts 19 and 20. These shafts extend through and are supported in fixed sleeves 15 and 16, and the shafts have bifurcated ends 21 best shown in FIG. 3 projecting beyond the outer ends of sleeves 15 and 16.

Figure 2:
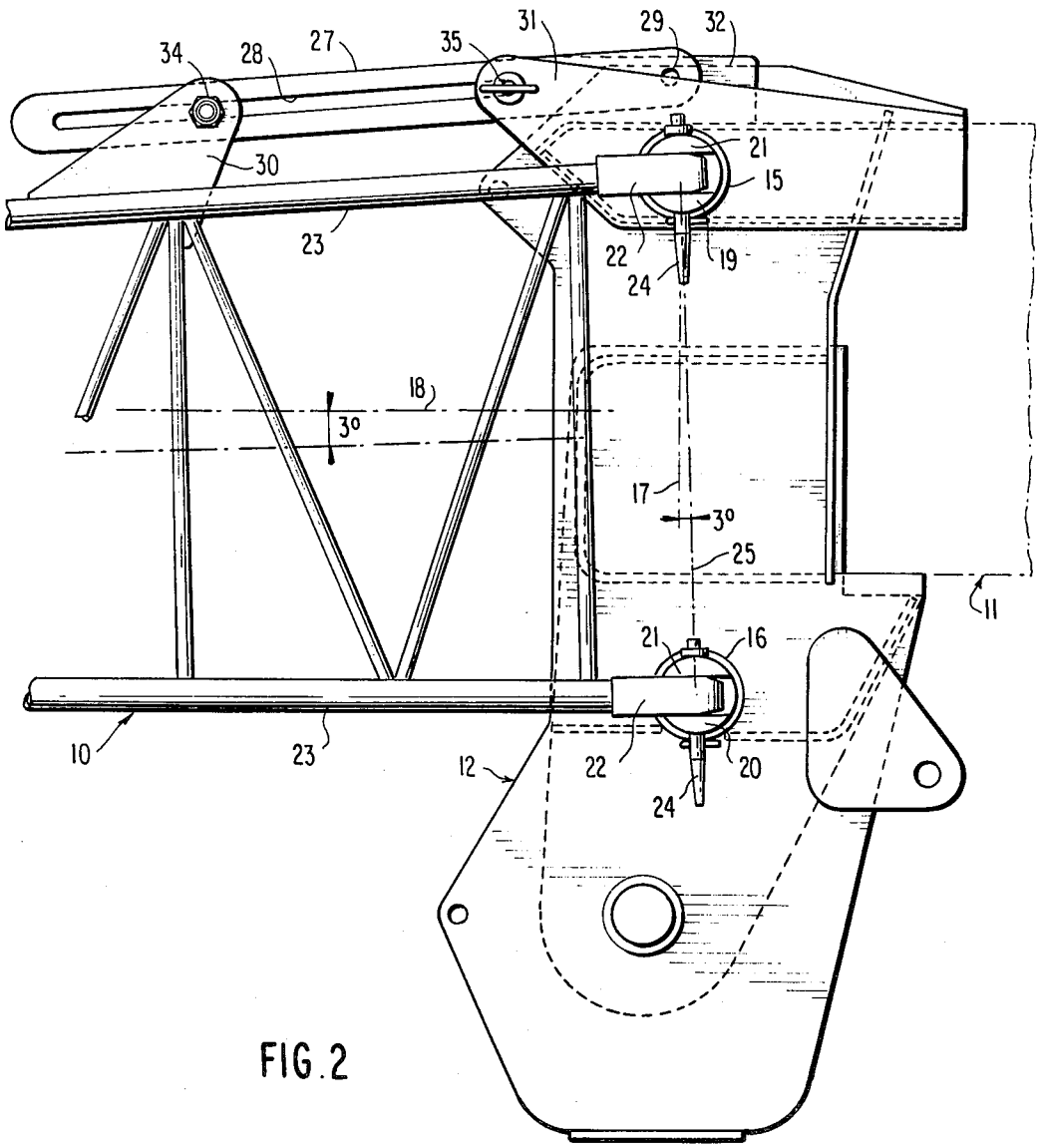
FIG. 2 is an enlarged fragmentary side elevation showing the base portion of the boom extension and its operating mechanism relative to the nose of a crane boom.
Figure 3:
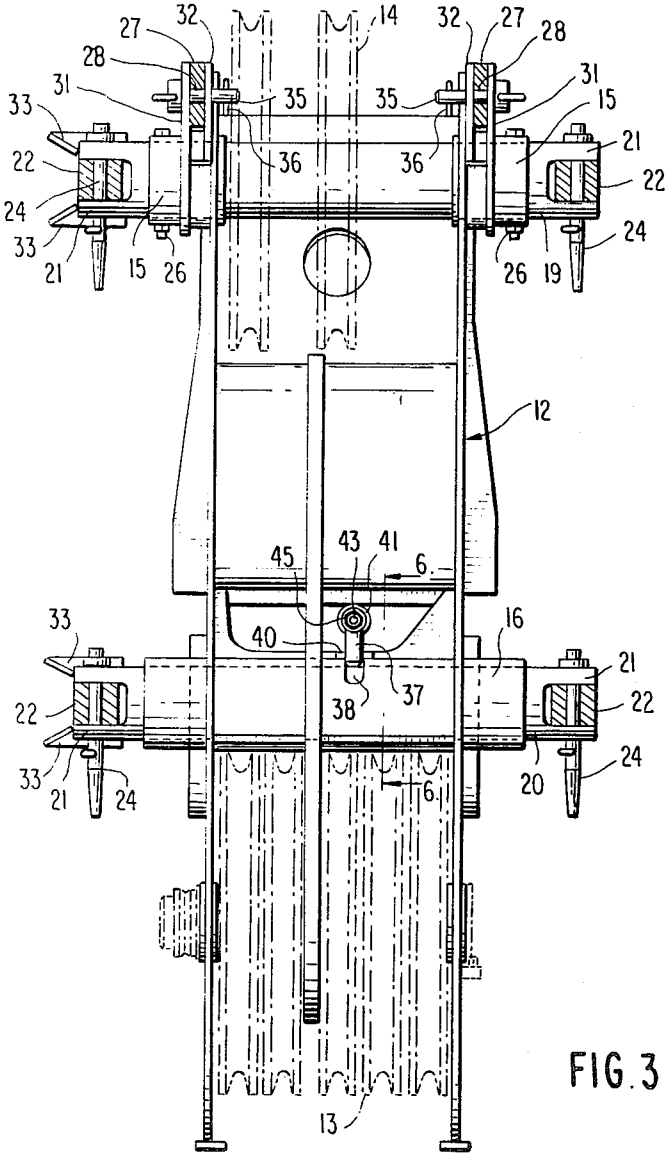
FIG. 3 is a front elevation of the structure shown in FIG. 2 with parts in section.

Block elements 22 welded to the four corner longitudinal bars 23 of boom extension 10 are received in the bifurcated extensions of shafts 19 and 20 and pinned therein by locking pins 24 engaging through provided apertures in the blocks 22 and bifurcated extensions 21, as best shown in FIG. 3. As viewed from their sides, FIGS. 2 and 5, the axes of the attaching block elements 22 at the upper and lower sides of the boom extension are parallel with each other and therefore perpendicular to the offset axis 25 through the centers of sleeves 15 and 16, FIG. 2. In this plane, the blocks 22 are not parallel to the axes of boom extension corner bars 23, which bars are forwardly convergent. As viewed from the top in FIG. 4, however, the block elements 22 can be parallel to the axes of bars 23.

For reasons to be described, the lower shaft 20 is freely rotatable in its support sleeve 16, whereas the upper shaft 19 is locked relative to the two sleeves 15 by through bolts 26 in the position shown in the drawings to establish the first use position of the boom extension 10 offset at 3° to the boom center line when the side stowed boom extension is swung around to the use position on the axis of one pair of the pins 24 in accordance with a well known procedure.

The particular mechanism utilized in the invention to enable the boom extension 10 to assume two additional major offset use positions shown in FIG. 1 and in FIG. 5 at approximately 15° and 30° below the center line 18 of the crane boom in a semi-automatic mode following a very simple ground level procedure comprises the following:

A pair of sturdy tension links 27 each having a straight longitudinal slots 28 and further having an aperture 29 near one end are disposed between a pair of spaced ears 30 welded to the cross bracing members 30' that are welded between the upper corner bars 23 of the boom extension somewhat forwardly of block elements 22. The links 27 are similarly received between spaced parallel ears or plates 31 and 32 forming welded components of the nose assembly 12. Other details of the nose assembly shown in the drawings are not important for a proper understanding of the invention and need not be described. It should be mentioned, however, that the bifurcated shaft ends 21 at one side of the nose assembly have guidance plates 33 fixed thereon to guide the adjacent block elements 22 into the bifurcated shaft extensions during the operation of swinging the boom extension 10 from its stowed position at one side of the crane boom 11 to the extended 3° offset use position.

The two tension links 27 are semi-permanently connected between the ears 30 by shouldered bolts 34 which engage slidably through the slots 28 of the links.

Figure 5:
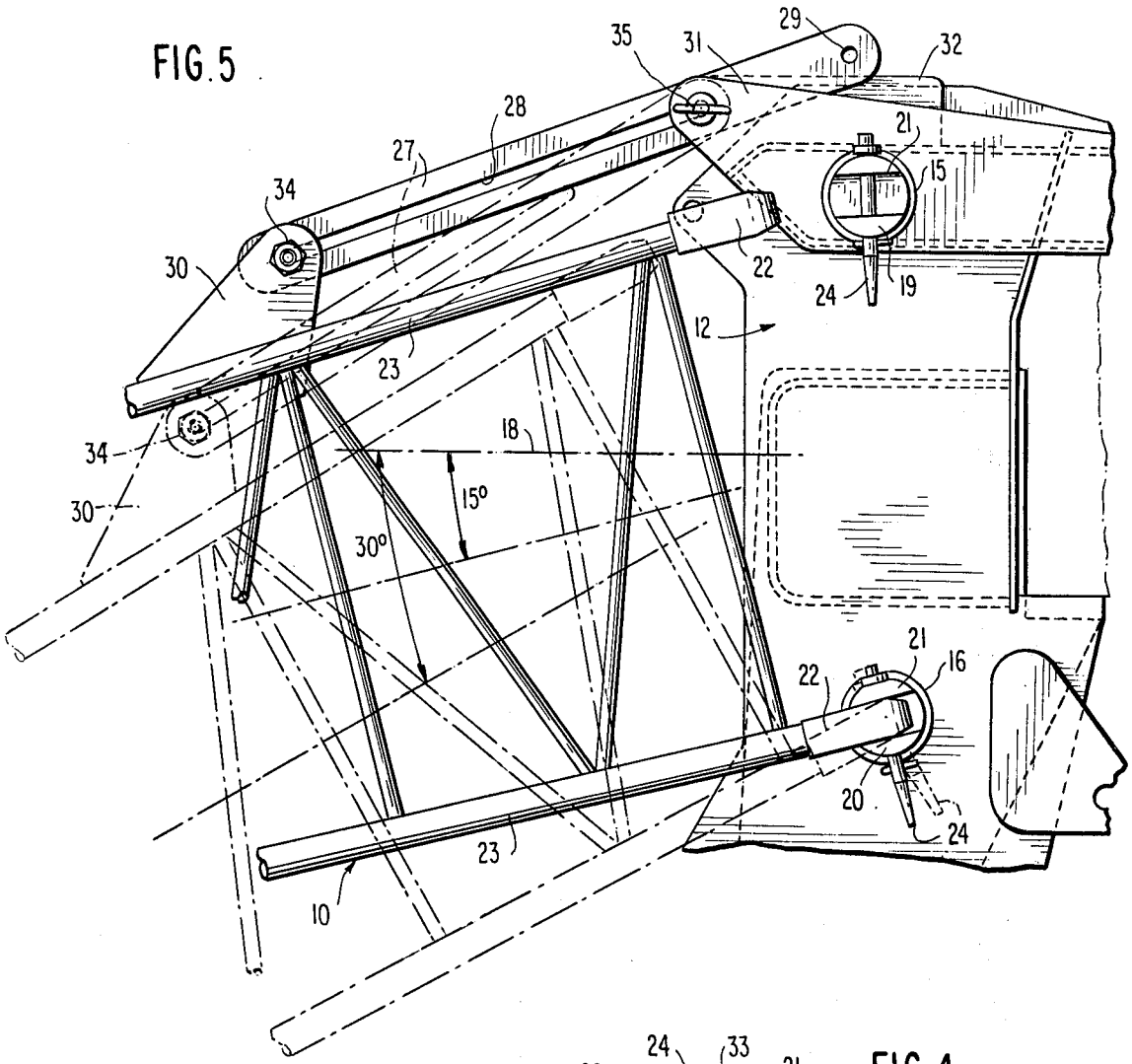
FIG. 5 is a side elevation similar to FIG. 2 showing the boom extension in the two major offset positions with its operating mechanism.
Figure 4:
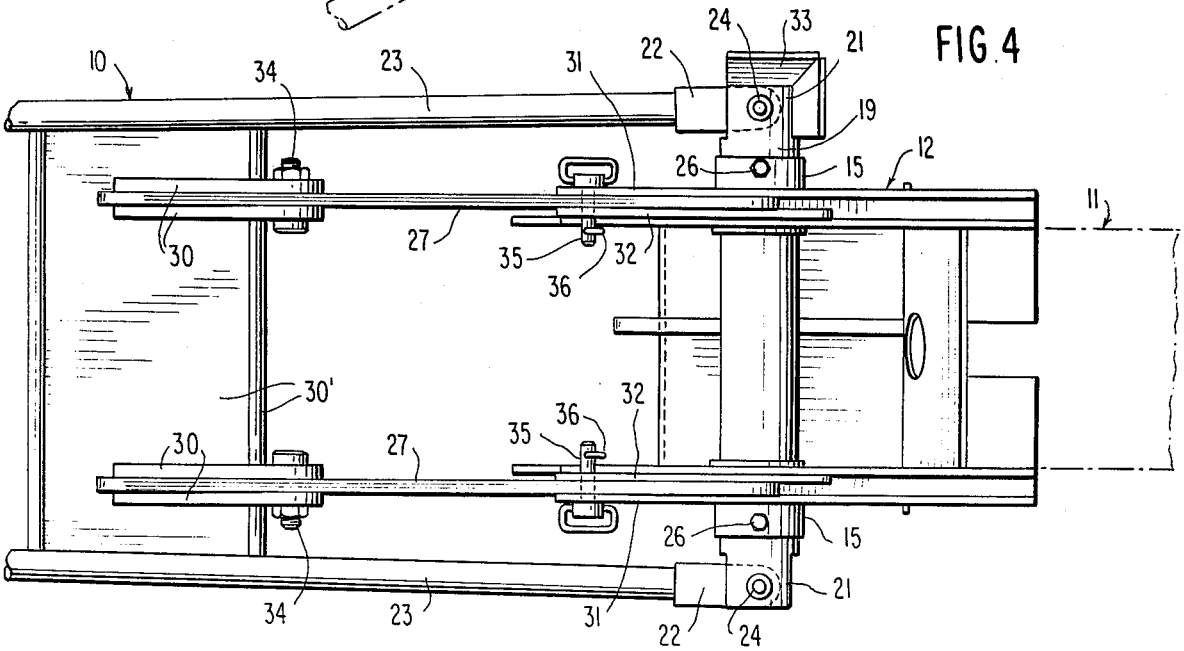
FIG. 4 is a plan view of the structure in FIG. 2.

Removable pins 35 including retainer elements 36 are similarly installed through the slots 28 and through registering apertures of the plates 31 and 32 to condition the links 27 for holding the boom extension 10 in the 15° offset use position shown in full lines in FIG. 5. In such position, the pins 35 will engage the ends of slots 28 away from bolts 34, which bolts are also engaging the forward ends of the slots 28.

When the links 27 are to be conditioned to support the boom extension 10 in the 30° offset position shown in broken lines in FIG. 5, the removable pins 35 are placed through the apertured plates 31 and 32 and through the aperture 29 at the rear end of each link. In both major use positions, as shown in FIG. 5, the upper side block elements 22 are separated from the pins 24 and upper bifurcated shaft ends 21, and the lower shaft 20 is allowed to rotate in the sleeve 16 while the boom extension and links 27 assume the proper offset positions with the assistance of gravity as will be further described.

A further feature of the invention shown primarily in FIG. 6 comprises a means for biasing the rotational lower shaft 20 and returning this shaft automatically to the position shown in FIG. 2 where the boom extension is in the 3° offset position, also shown in FIG. 1, and therefore ready to accept within its bifurcated ends 21 the two lower side block elements 22, as when the stowed boom extension is first being brought into engagement with corresponding ends of the shafts 19 and 20 at one side of the nose assembly 12.

The biasing means for the shaft 20 comprises a radial pin 37, FIG. 6, extending through a slot 38 in the fixed sleeve 16 and being anchored to the shaft 20 by a threaded extension 39. A stop and locator plate 40 for the radial pin 37 having an arcuate notch is welded to the sleeve 16. A cross sleeve 41 welded to the outer end of pin 37 receives in its bore slidably an adjusting plunger 42 having a threaded extension 43 carrying an adjusting nut 44 and locking nut 45. The other end of plunger 42 is connected with a retractile spring 46, in turn connected with a fixed element 47 forming a part of the nose assembly 12. With this arrangement, the tension of biasing spring 46 can be regulated, and the spring through the pin 37 will bias the rotary shaft 20 to the position shown in FIG. 6 for the purpose already specified.

A feature of the invention is that the adjustment of the boom extension 10 to either of its two major offset positions, 15° or 30°, can be done from ground level. The crane boom 11 is depressed to an approximately level position, the boom extension, if stowed at one side of the crane boom, is pivoted in its supports to move one pair of its block elements 22 into engagement with the adjacent bifurcated shaft ends 21, with the assistance of guide plates 33, and one pair of the pins 24 is placed to lock the block elements 22 to the two shaft ends. The boom extension is then swung around on the axes of the two pins 24 until the block elements 22 at the other side of the boom extension enter the opposite side bifurcated shaft extensions 21, and the other two pins 24 are placed. This locates the boom extension at the normal 3° offset use position. If already in this position, the previously described steps for deploying the boom extension 10 from its stowed position obviously are not necessary prior to achieving either the 15° or 30° offset positions of the boom extension 10.

In either case, the crane boom 11 is lowered to a negative angle and the forward end of extension 10 is allowed to rest on the ground or on some low support so as to relieve the two upper side connecting pins 24 of any loading. The two links 27, which are stored as shown in FIG. 2, or in some cases with their rear ends down inside of the boom extension 10 while the bolts 34 remain in place, are raised and placed between the plates 31 and 32 of the nose assembly 12. The links 27 can be moved lengthwise because of the slots 28, and when properly positioned the pins 35 are placed through the apertures in plates 31 and 32 and through the slots 28. The two upper pins 24 are then pulled to release the two upper block elements 22 from their connections with the upper shaft 19. Following this, the crane boom is elevated and with the assistance of gravity the boom extension 10 and the tension links 27 will assume automatically their positions shown in full lines in FIG, 5, with the bolts 34 resting at the forward ends of slots 28 and the pins 35 at the rear ends of these slots. The ability of the lower shaft 20 to rotate automatically in the sleeve 15 at this time enables the boom extension 10 to assume the 15° offset position automatically as the crane boom is elevated. It is this rotational ability of lower shaft 20 and the provision of the slots 28 which enables the 15° and 30° offset connections for the boom extension to be made from ground level.

When it is desired to use the boom extension 10 in the full 30° offset position for greater reach, the same procedure described above is followed, except that the pins 35 are placed through the link apertures 29 instead of through their slots 28.

A distinct advantage of the invention over the prior art resides in the ability to make the necessary connections at ground level and to use the same links 27 for supporting the boom extension 10 in both the 15° and the 30° offset positions. In U.S. Pat. No. 3,831,771, for example, separate interchangeable links must be used to position a boom extension in two positions of use. Furthermore, the present invention is safer in its mode of use than the prior art. For example, the pins 35 are safely set into place prior to pulling the upper pins 24.

The terms and expressions which have been employed herein are used as terms of description and not of limitation, and there is no intention, in the use of such terms and expressions, of excluding any equivalents of the features shown and described or portions thereof but it is recognized that various modifications are possible within the scope of the invention claimed.

I claim:

1. In a crane boom having a nose assembly including an upper support shaft and a lower rotational support shaft, a boom extension including elements near the base of the boom extension adapted for engagement with the upper and lower support shafts, disengageable connecting means securing the base of the boom extension to said upper and lower support shafts for supporting the boom extension normally in a first angular offset position relative to the center line of the crane boom, anchor means on the boom extension in proximity to the base thereof and on the boom nose assembly, a link extending between said anchor means, a slot provided in said link, a first connecting element extending through said anchor means on said boom extension and said slot, a second removable connecting element extending through said anchor means on the boom nose assembly and said slot, the first removable connecting element being spaced from one end of said slot and the second removable connecting element engaging the other end of said slot when said boom extension is disposed in said first angular offset position, said first and second connecting elements being inoperative in defining said first angular offset position, each end of said slot being respectively engaged by said first and second connecting elements to define a second angular offset position relative to the center line of the crane boom when said connecting means is disengaged from said upper support shaft.

2. In a crane boom as defined in claim 1, and said upper and lower support shafts including bifurcated ends, said boom extension near its base having block elements engageable within the bifurcated shaft ends, and said disengageable connecting means comprising pins engageable through registering apertures of said block elements and bifurcated shaft ends, at least the connecting pins for the upper shaft being removable to release the block elements of the boom extension adjacent to the upper shaft.

3. In a crane boom as defined in claim 1, and said upper and lower shafts having parallel axes which are offset from each other to define a small angle between a plane through their axes and a true vertical plane across the center line of the crane boom when the crane boom is level, whereby said boom extension can assume said first angular offset position from the center line of the crane boom when said elements near the base of the boom extension are connected at right angles to the upper and lower shafts with relation to the plane through their axes.

4. In a crane boom as defined in claim 3, and means connected with and biasing the lower rotational support shaft to a position facilitating engagement of said elements with the upper support shaft to locate said boom extension in said first angular offset position.

5. In a crane boom as defined in claim 1, and means connected with and biasing said lower rotational support shaft to a position facilitating engagement of said elements with the upper rotational support shaft.

6. In a crane boom as defined in claim 5, and said biasing means including a spring connected between the lower rotational shaft and a fixed part of said nose assembly, and means to adjust the tension of said spring.

7. In a crane boom as defined in claim 1, and means locking the upper support shaft against rotation on the nose assembly.

8. In a crane boom having a nose assembly including an upper support shaft and a lower rotational support shaft, a boom extension including elements near the base of the boom extension adapted for engagement with the upper and lower support shafts, disengageable connecting means securing the base of the boom extension to said upper and lower support shafts for supporting the boom extension in a first angular offset position relative to the center line of the crane boom, anchor means on the boom extension in proximity to the base thereof and on the boom nose assembly, a link extending between said anchor means, a slot provided in said link, a first connecting element extending through said anchor means on said boom extension and said slot, a second removable connecting element extending through said anchor means on the boom nose assembly and said slot, each end of said slot being respectively engaged by said first and second connecting elements to define a second angular offset position relative to the center line of the crane boom when said connecting means is disengaged from said upper support shaft, the link having an aperture spaced from one end of the slot, the second connecting element being removable from said slot and insertable through the anchor means on said boom nose assembly and said aperture to define a third angular offset position relative to the center line of the crane boom when said connecting means is disengaged from said upper support shaft.

9. In a crane boom as defined in claim 8, wherein a pair of slotted links extend between each anchor means for the support of the boom extension in said second and third angularly offset positions, and said first and second connecting elements extending between each link of said pair and the anchor means on said boom extension and on the nose assembly.

10. An offset boom extension for a crane boom having a nose assembly comprising, a rotational support shaft operatively connected to said nose assembly, portions on said boom extension in proximity to the base thereof for engagement with said rotational support shaft, first anchor means operatively connected to the boom extension in proximity to the base thereof, second anchor means operatively connected to the boom nose assembly, a link extending between said first and second anchor means, a slot provided in said link, an aperture in said link longitudinally spaced from an end of said slot, a first connecting element extending through one of said first and second anchor means and said slot, a second connecting element extending through the other of said first and second anchor means and said link aperture, said first connecting element engaging one end of said slot in proximity to one end of said link, said second connecting element extending through the aperture in proximity to the opposite end of said link, to thereby define an angular offset working position of the boom extension relative to the center line of the crane boom.

11. An offset boom extension according to claim 10, wherein the first connecting element extends through the first anchor means.

12. An offset boom extension according to claim 10, wherein the second connecting element extends through the second anchor means.

* * * * *